US005575064A

United States Patent [19]

Fujiwara et al.

[11] Patent Number: 5,575,064

[45] Date of Patent: Nov. 19, 1996

[54] PROCESS FOR PRODUCING ROCKER ARM FOR INTERNAL COMBUSTION ENGINE

[75] Inventors: Akira Fujiwara; Noriyuki Yamada; Kazushige Yakubo, all of Wako, Japan

[73] Assignee: Honda Giken Kogyo Kabushiki Kaisha, Tokyo, Japan

[21] Appl. No.: 354,024

[22] Filed: Dec. 6, 1994

[51] Int. Cl.[6] ..... B23P 15/00

[52] U.S. Cl. ..... 29/888.2

[58] Field of Search ..... 29/888.2; 74/519, 74/554

[56] References Cited

U.S. PATENT DOCUMENTS

| | | | |
|---|---|---|---|
| 1,649,398 | 11/1927 | Fry . | |
| 3,166,835 | 1/1965 | Kolbe | 29/888.2 |
| 4,624,223 | 11/1986 | Wherry et al. | 29/888.2 |
| 4,825,717 | 5/1989 | Mills | 29/888.2 |
| 4,829,647 | 5/1989 | Anderson | 29/888.2 |
| 4,848,180 | 7/1989 | Mills | 29/888.2 |
| 4,955,121 | 9/1990 | Sato et al. | 29/888.2 |

FOREIGN PATENT DOCUMENTS

| | | |
|---|---|---|
| 1199006 | 8/1965 | Germany . |
| 2333183 | 4/1974 | Germany . |
| 4205647 | 8/1993 | Germany . |
| 63-166947 | 7/1988 | Japan . |
| 149752 | 12/1931 | Switzerland . |

OTHER PUBLICATIONS

K. Daeves, "Werkstoff—Handbuch Stahl Und Eisen", 1965.

*Primary Examiner*—Irene Cuda

*Attorney, Agent, or Firm*—Nikaido, Marmelstein, Murray & Oram LLP

[57] ABSTRACT

In producing a rocker arm, following steps are used: fabricating a rocker arm blank which includes: a rocker arm body having an aperture therein adapted to be converted to a hole for the insertion of a shaft, and which blank is made of a nitrided steel comprising specified amounts of C, Mn, Cr, Al, Si, P, S, Cu, Ni, one of Pb and Bi, and optionally Mo, and, as the balance substantially, Fe; and a slipper surface forming piece; subjecting the rocker arm blank to a refining treatment to adjust its hardness; subjecting the apertures to reaming to form the shaft insertion holes; and subjecting the rocker arm blank with the shaft insertion holes formed therein to a nitriding treatment. Thus, it is possible to mass-produce rocker arms for an internal combustion engine, each of which has excellent mechanical properties.

2 Claims, 5 Drawing Sheets

PROCESS FOR PRODUCING ROCKER ARM FOR INTERNAL COMBUSTION ENGINE

BACKGROUND OF THE INVENTION

1. Field of the Invention

The present invention relates to a process for producing a rocker arm for an internal combustion engine.

2. Description of the Prior Art

In general, in producing such a rocker arm, the following steps have been conventionally used: a step of fabricating a rocker arm blank formed of carburized steel, which has apertures adapted to be converted to shaft insertion holes provided therein; a step of subjecting the periphery of the apertures to a reaming operation to properly size and shape the shaft insertion holes; after such reaming, a step of subjecting the rocker arm blank to a carburization hardening treatment in order to increase the wear resistance, or the like, of an inner peripheral surface of each of the shaft insertion holes; a step of subjecting the rocker arm blank to a barreling in order to remove oxides from the surface of the rocker arm blank; and a step of subjecting the shaft insertion holes to a honing in order to remove such thermal strain as may have been introduced due to the carburization hardening treatment.

The reason why the shaft insertion holes are formed by reaming prior to the carburization hardening treatment as described above, is that the reaming can not be performed after the carburization hardening treatment, because the hardness of the inner wall of the shaft insertion holes is increased by the carburizing treatment.

With the prior art process, however, two machinings i.e., reaming and honing, are required for each shaft insertion hole, resulting in an increased number of steps needed to produce each rocker arm. In addition there is another problem. Each blank must be separately honed, resulting in a lower efficiency of production of the rocker arm. Thus, an increase in the cost of manufacturing the rocker arm cannot be avoided.

SUMMARY OF THE INVENTION

Accordingly, it is an object of the present invention to provide a rocker arm producing process, of the general type described above, which has an excellent mass-productivity provided by utilizing a specially designed steel material from which the rocker arm blank is formed, conducting the two thermal-treating steps in a particular sequence, as well as specifying the point in the overall process at which the shaft insertion holes are completely formed by machining.

To achieve the above object, according to the present invention, there is provided a process for producing a rocker arm for an internal combustion engine, comprising the steps of:

fabricating a rocker arm blank which has an aperture adapted to be converted into a shaft insertion hole, and which is made of steel whose composition comprises 0.3% (inclusive) to 0.5% (inclusive) by weight of carbon (C), 0.3% (inclusive) to 1.5% (inclusive) by weight of manganese (Mn), 0.9% (inclusive) to 1.5% (inclusive) by weight of chromium (Cr), 0.7% (inclusive) to 1.5% (inclusive) by weight of aluminum (Al), 0.35% by weight or less of silicon (Si), 0.03% by weight or less of phosphorus (P) 0.03% by weight or less of sulfur (S), 0.3% by weight or less of copper (Cu), 0.25% by weight or less of nickel (Ni), at least one of 0.04% (inclusive) to 0.15% (inclusive) by weight of lead (Pb) and 0.03% (inclusive) to 0.1% (inclusive) by weight of bismuth (Bi), and, as the balance, substantially iron (Fe)with normal impurities;

subjecting the rocker arm blank to a refining treatment which comprises hardening it by heat treatment at a temperature ($T_1$) of 850 (inclusive) to 950° C. (inclusive) for a treating time ($t_1$) of 0.5 (inclusive) to 2 (inclusive) hours, and subjecting the heat treated rocker arm blank to tempering at a tempering temperature ($T_2$) of 600 (inclusive) to 700° C.(inclusive) for a tempering time ($t_2$) of 0.5 (inclusive) to 2 (inclusive) hours;

subjecting the aperture in the heat treated and tempered blank to a reaming to form the shaft insertion hole; and subjecting the rocker arm blank, with the shaft insertion hole formed therein, to a nitriding treatment at a nitriding temperature ($T_3$) of 550 (inclusive) to 610° C. (inclusive) for a nitriding time ($t_3$) of 5 (inclusive) to 8 (inclusive) hours.

The above-described nitrided steel may, optionally, further contain 0.15% (inclusive) to 0.3% (inclusive) by weight of molybdenum (Mo) in addition to the above-described chemical constituents.

If the rocker arm blank having the composition specified, as described above, is subjected to the refining treatment as described above, its properties, such as ductility and toughness, will have been improved to levels optimal for a rocker arm, and the hardness of the blank can be adjusted to a value (HRC) in the range of about 20 to 30, which values are those minimally required to achieve the required strength, when the machinability of the blank is also taken into consideration.

In the rocker arm blank obtained as a result of the refining treatment set forth above, the shaft insertion holes can be easily formed by subjecting the apertures to a reaming operation.

The nitriding treatment causes a surface hardening of the entire rocker arm blank, and improved wear resistance is provided to open surfaces and the inner surface of each shaft insertion hole. Because the nitriding treatment is carried out at a relatively low temperature, thermal strain and the like are not produced in the shaft insertion hole and therefore, finishing of the shaft insertion hole, by machining after the nitriding treatment, is not required.

The fabrication of the rocker arm blank of this invention is performed with good efficiency by using forging, machining, or the like treatments, and a refining treatment. The reaming and the nitriding treatment can be carried out upon a large number of rocker arm blanks at the same time, leading to an improved mass-productivity of the rocker arm of this invention.

The effects of the alloy elements and the reason why the contents of these elements are specified to be essential to the practice of this invention will be described below.

Carbon (C) has the effect of enhancing the core portion of the blank, which is to be covered with a nitrided layer, to increase the tensile strength of a produced rocker arm. However, if the C content is less than 0.3% by weight, such effect is not obtained. On the other hand, if the C content is more than 0.5% by weight, a notched portion in a produced rocker arm has a reduced fatigue strength.

Manganese (Mn) has the effect of enhancing the hardness of the core portion of the rocker arm blank, as does the carbon (C). However, if the Mn content is less than 0.3% by weight, such effect is not obtained. On the other hand, if the Mn content is more than 1.5% by weight, the machinability of the rocker arm blank is degraded as a result of the coalescence of inclusions in the steel.

Chromium (Cr) has the effect of promoting the nitriding of the rocker arm blank to increase the depth of the nitrided layer and to increase the fatigue strength of the resulting rocker arm. However, if the Cr content is less than 0.9% by weight, such effect is not obtained. On the other hand, if the Cr content is more than 1.5% by weight, the machinability of the rocker arm blank is lowered.

Similar to chromium (Cr) aluminum (Al) has the effect of increasing the depth of the nitrided layer, and the effect of enhancing the hardness of the nitrided layer to improve the wear resistance of the rocker arm. However, if the Al content is less than 0.7% by weight, such effects are not obtained. On the other hand, if the Al content is more than 1.5% by weight, the toughness of the nitrided layer is reduced.

Silicon (Si) has the effect of enhancing the toughness of a rocker arm. However, if the Si content is less than 0.35% by weight, such effect is not obtained, and the machinability of the rocker arm blank is degraded.

Phosphorus (P) and sulfur (S) are elongation reducing elements and hence, the P content is set in a range represented by P<0.03% by weight, and the S content is set in a range represented by S<0.03% by weight.

The copper (Cu) has the effect of strengthening the steel matrix. However, if the Cu content is more than 0.3% by weight, the machinability of the rocker arm blank is reduced.

Nickel (Ni) has an effect similar to the effect of the copper. However, if the Ni content is more than 0.25% by weight, the machinability of the rocker arm blank is reduced.

Each of lead (Pb) and bismuth (Bi) have a machinability of enhancing effect. However, if the Pb content is less than 0.04% by weight or if the Bi content is less than 0.03% by weight, the machinability of the rocker arm blank is degraded. On the other hand, if the Pb content is more than 0.15% by weight or if the Bi content is more than 0.1% by weight, the rocker arm produced from such steel has a reduced fatigue strength.

Molybdenum (Mo) has a nitriding promoting effect, i.e., an effect of increasing the hardness of a diffused layer of nitrogen and the effect of enhancing the hardenability of the steel to increase the hardness of the core portion of the rocker arm. However, if the Mo content is less than 0.15% by weight, such effects are not obtained. On the other hand, if the Mo content is more than 0.3% by weight, the machinability of the rocker arm blank is lowered.

If the heat treating temperature ($T_1$) is lower than 850° C. and/or the heat treating time ($t_1$) is less than 0.5 hour in the hardening portion of the refining treatment, the structure does not achieve its desired hardness because the hardness of the core portion is low. On the other hand, if ($T_1$)>950° C. and ($t_1$)>2 hours, cracks are produced during the hardening portion of the refining treatment.

If the tempering treating temperature ($T_2$) is lower than 600° C. and/or the tempering treating time ($t_2$) is less than 0.5 hours in the tempering portion of the refining treatment, machinability is lowered because of higher hardness. On the other hand, if ($T_2$)>700° C. and/or ($t_2$)>2 hours, the rocker arm does not achieve the required strength.

If the nitriding treating temperature ($T_3$) is less than 500° C. and the treating time ($t_3$) is less than 5 hours, a sufficient depth of the nitrided layer is not obtained. On the other hand, if ($T_3$)>610° C. and/or ($t_3$)>8 hours, the strain in the produced rocker arm is increased to unacceptable levels.

Thus, with the practices of the process according to the present invention, it is possible to easily mass-produce rocker arms having excellent mechanical properties, thereby reducing the manufacture cost of the rocker arms.

The above and other objects, features and advantages of the invention will become apparent from the following description of the preferred embodiment taken in conjunction with the accompanying drawings.

DESCRIPTION OF THE PREFERRED EMBODIMENT

Figure 1:
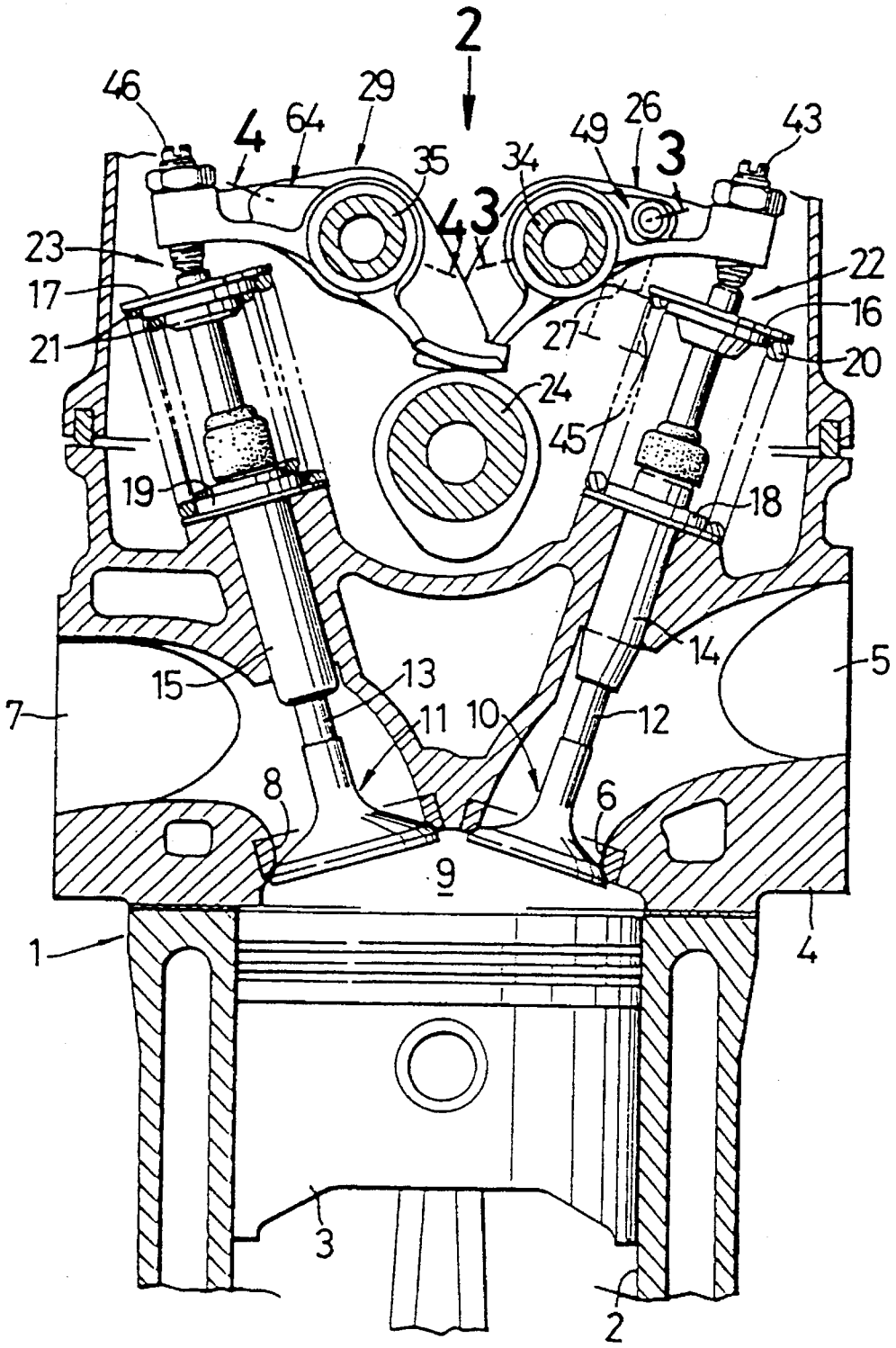
FIG. 1 is a vertical sectional view of an internal combustion engine.

FIGS. 1 to 5 illustrate an internal combustion engine including a valve operation characteristic changing means. In this engine, as shown in FIG. 1, a piston 3 is slidably received in a cylinder bore 2 in a cylinder block 1. A pair of intake bores 6 are defined adjacent each other in a cylinder head 4 to communicate with an intake port 5, and a pair of exhaust bores 8 are also defined adjacent each other in the cylinder head 4 to communicate with an exhaust port 7. These bores 6 and 8 open toward a combustion chamber 9.

An intake valve 10 is disposed in each of the intake bores 6, and an exhaust valve 11 is disposed in each of the exhaust bores 8. Valve rods 12 and 13 of the intake and exhaust valves 10 and 11, respectively, are slidably inserted through guide sleeves 14 and 15, respectively, mounted in the cylinder head 4. Retainers 16, 17, 18 and 19 are mounted at upper ends of the valve rods 12 and 13 and the guide sleeves 14 and 15. Valve springs 20 and 21 are compressed between the opposed retainers 16 and 18 as well as 17 and 19, respectively. By resilient forces of the valve springs 20 and 21, the intake valve 10 is biased in a direction to close the intake bore 6, and the exhaust valve 11 is biased in a direction to close the exhaust bore 8.

Each of the intake valves 10 and each of the exhaust valve 11 are opened and closed by an intake-side valve operating mechanism 22 and an exhaust-side valve operating mechanism 23, respectively. The valve operating mechanisms 22 and 23 are provided with a single common cam shaft 24 which is driven at a rotational ratio of ½ synchronously with the revolution of the engine.

Figure 2:
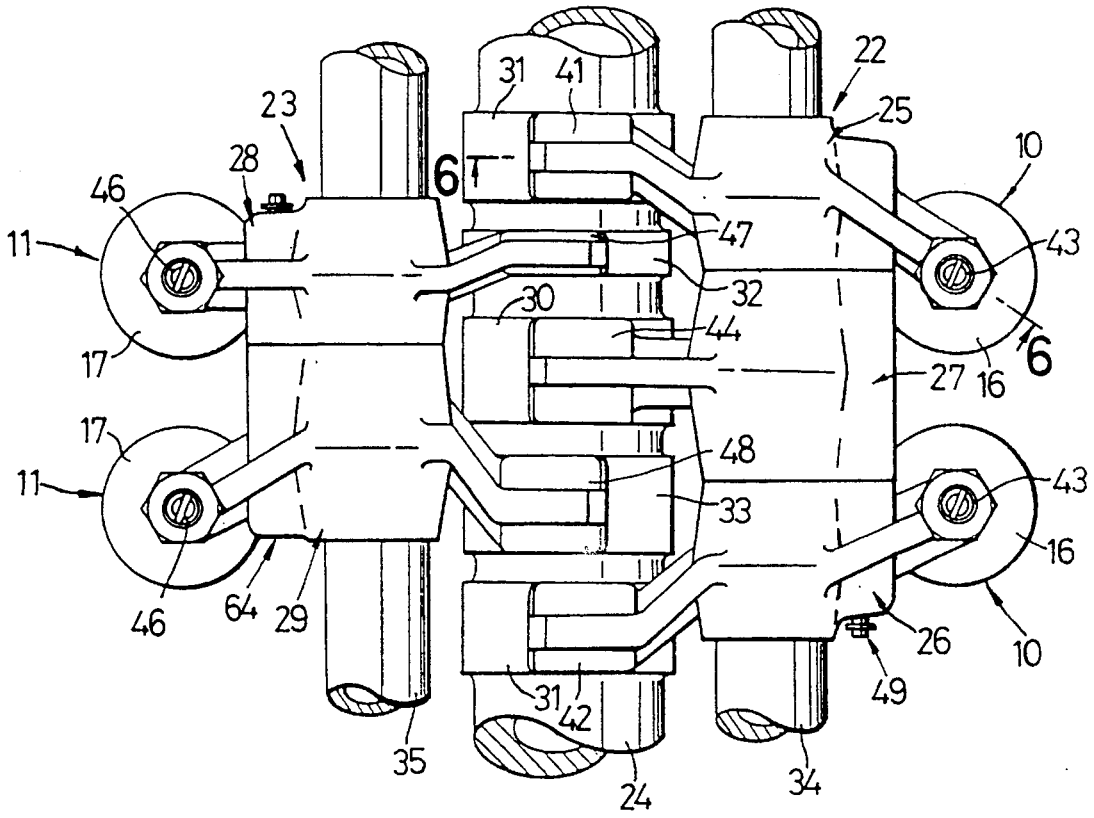
FIG. 2 is a view looking in the direction of the arrow 2 (Bold) in FIG. 1.

As shown in FIG. 2, the intake-side valve operating mechanism 22 includes the cam shaft 24, and first, second and third intake-side rocker arms 25, 26 and 27 provided between the cam shaft 24 and the intake valves 10. The exhaust-side valve operating mechanism 23 includes the cam shaft 24, and first and second exhaust-side rocker arms 28 and 29 provided between the cam shaft 24 and the exhaust valves 11. The cam shaft 24 includes a first intake-side cam 30 operative in correspondence with a high-speed operating range for the engine, a pair of second intake-side cams 31 operative in correspondence with a low-speed operating range for the engine, a circular raised portion 32 disposed between the first intake-side cam 30 and one of the second intake-side cams 31 to correspond to circular base portion of these cams 30 and 31, and one exhaust-side cam 33 disposed between the first intake-side cam 30 and the other second intake-side cam 31.

Figure 3:
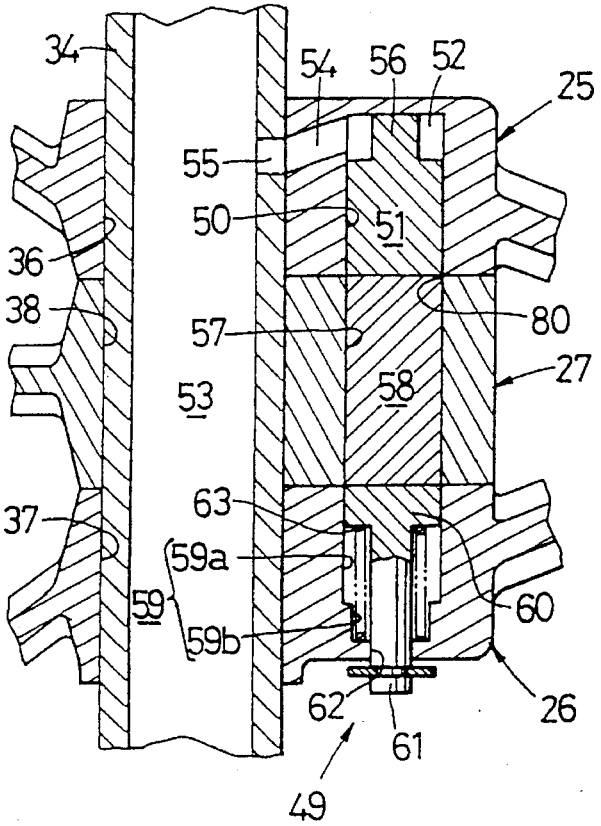
FIG. 3 is a sectional view taken along a line 3—3 in FIG. 1 looking in the direction of the arrows and illustrating the condition, before switching, of an intake valve operation characteristic changing means.
Figure 4:
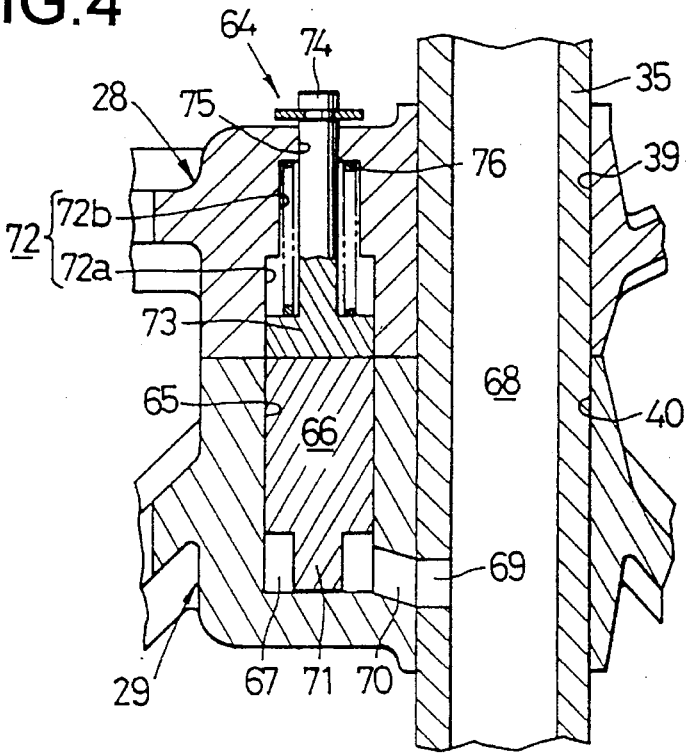
FIG. 4 is a sectional view taken along a line 4—4 in FIG. 1 looking in the direction of the arrows and illustrating condition, before switching, of an exhaust valve operation characteristic changing means.

A pair of rocker shafts 34 and 35 are disposed parallel to the cam shaft 24. The first, third and second intake-side rocker arms 25, 27 and 26 are pivotally carried in the named order in mutually sliding contact on one of the rocker shafts 34 with support holes 36, 37 and 38 located therebetween, as shown in FIGS. 2 and 3. The exhaust-side rocker arms 28 and 29 are pivotally carried in mutually sliding contact on the other rocker shaft 35 with support holes 39 and 40 located therebetween, as shown in FIG. 4.

Each of the first and second intake-side rocker arms 25 and 26 has a slipper surface forming piece 41, 42 provided at one end, respectively to come into sliding contact with the second intake-side cam 31 from above, and a tappet screw 43 provided at the other end to abut against the upper end of the valve rod 12 of the intake valve 10. The third intake-side rocker arm 27 has a slipper surface forming piece 44 provided at one end to come into sliding contact with the first intake-side cam 30 from above, and a bottomed cylindrical lifter 45 abuts against a lower surface of the other end of the third intake-side rocker arm 27. The lifter 45 is biased upwardly by the resilient force of a spring (not shown) compressed between the lifter 45 and the cylinder head 4, thereby bringing the slipper surface forming piece 44 into normally sliding contact with the first intake-side cam 30. Further, each of the first and second exhaust-side rocker arms 28 and 29 has a tappet screw 46 provided at one end to abut against the upper end face of the valve rod 13 of the exhaust valve 11. A slipper surface forming piece 47 is provided at the other end of the first exhaust-side rocker arm 28 to come into sliding contact with the raised portion 32, and further, a slipper surface forming piece 48 is provided at the other end of the second exhaust-side rocker arm 29 to come into sliding contact with the exhaust-side cam 33.

Referring to FIG. 3, an intake valve operation characteristic changing means 49 is provided among the first, second and third intake-side rocker arms 25, 26 and 27. The intake valve operation characteristic changing means 49 will be described below. A first guide hole 50 is provided in the first intake-side rocker arm 25 in parallel to the rocker shaft 34, and opens toward the third intake-side rocker arm 27. A first connecting pin 51 is slidably fitted in the first guide hole 50, and a hydraulic pressure chamber 52 is defined between a closed end of the first guide hole 50 and the first connecting pin 51. An oil passage 53 is provided in the rocker shaft 34 to lead to a hydraulic pressure supply source (not shown) and normally communicate with the hydraulic pressure chamber 52 via through-holes 54 and 55.

A projection 56 is coaxially provided on one end face of the first connecting pin 51 and abuttable against the closed end of the first guide hole 50. The length of the first connecting pin 51 is determined such that when the projection 56 has been put into abutment against the closed end of the first guide hole 50, the other end face is located at an open end of the first guide hole 50.

A guide hole 57 is provided through the third intake-side rocker arm 27. The guide hole 57 is coaxial with the first guide hole 50 and has the same diameter as the first guide hole 50. A second connecting pin 58 having the same length as the guide hole 57 is slidably fitted in the guide hole 57 and has the same diameter as the first connecting pin 51.

The second intake-side rocker arm 26 is provided with a bottomed and stepped second guide hole 59 which opens toward the third intake-side rocker arm 27 and lies coaxially with the guide hole 57. A disk-like stopper 60 having the same diameter as the second connecting pin 58 is slidably fitted in a larger diameter portion 59*a* of the second guide hole 59, and has a shaft portion 61 coaxially and projectingly provided thereon and loosely inserted in a smaller-diameter portion 59*b* of the second guide hole 59. A guide hole 62 is coaxially provided extending from a closed end of the second guide hole 59, and the shaft portion 61 is slidably inserted through the second guide hole 62.

A coiled return spring 63 is compressed between the stopper 60 and the closed end of the smaller-diameter portion 59*b* of the second guide hole 59 to surround the shaft portion 61, so that the stopper 60 and the first and second connecting pins 51 and 58 are biased toward the hydraulic pressure chamber 52 by a resilient force of the return spring 63.

Referring to FIG. 4, an exhaust valve operation characteristic changing means 64 is provided between the first and second exhaust-side rocker arms 28 and 29. The changing means 64 will be described below. The second exhaust-side rocker arm 29 is provided with a guide hole 65 which opens toward the first exhaust-side rocker arm 28 and is parallel to the rocker shaft 35. A connecting pin 66 is slidably fitted in the guide hole 65, and a hydraulic pressure chamber 67 is defined between the connecting pin 66 and a closed end of the guide hole 65. An oil passage 68 is provided in the rocker shaft 35 to lead to the hydraulic pressure supply source (not shown) and is normally in communication with the hydraulic pressure chamber 67 by means of through-holes 69 and 70.

The connecting pin 66 has a projection 71 coaxially provided at one end face thereof which is abutted against the closed end of the guide hole 65. The axial length of the connecting pin 66 is determined such that the other end face is located at an open end of the guide hole 65, when the projection 71 abuts against the closed end of the guide hole 65.

The first exhaust-side rocker arm 28 is provided with a bottomed and stepped guide hole 72 which opens toward the second exhaust-side rocker arm 29 and lies coaxially with the guide hole 65. A disk-line stopper 73 having the same diameter as the connecting pin 66 is slidably fitted in a larger-diameter portion 72*a* of the guide hole 72, and has a shaft portion 74 coaxially and projectingly provided thereon and loosely fitted in a smaller-diameter portion 72*b* of the guide hole 72. A smaller guide hole 75 is coaxially provided in a closed end of the guide hole 72, and the shaft portion 74 is slidably inserted through the smaller guide hole 75.

A coiled return spring 76 is compressed between the stopper 73 and the closed end of the smaller-diameter portion 72*b* to surround the shaft portion 74. The stopper 73 and the connecting pin 66 are biased toward the hydraulic pressure chamber 67 by a resilient force of the return spring 76.

In the above-described construction, when the engine is in a low speed operation, no hydraulic pressure is supplied to the hydraulic pressure chambers 52 and 67 in the intake valve operation characteristic changing means 49 and the exhaust valve operation characteristic changing means 64.

At this time, the first, second and third rocker arms 25, 26 and 27 are in relative swinging states, and the first and second exhaust rocker arms 28 and 29 are also in relative swinging states. Therefore, both the intake valves 10 are opened and closed in accordance with the movements of the second intake-side cams 31, and one of the exhaust valves 11 is opened and closed in accordance with the movement of the exhaust-side cam 33, while the other exhaust valve 11 is in a stopped state.

Figure 5:
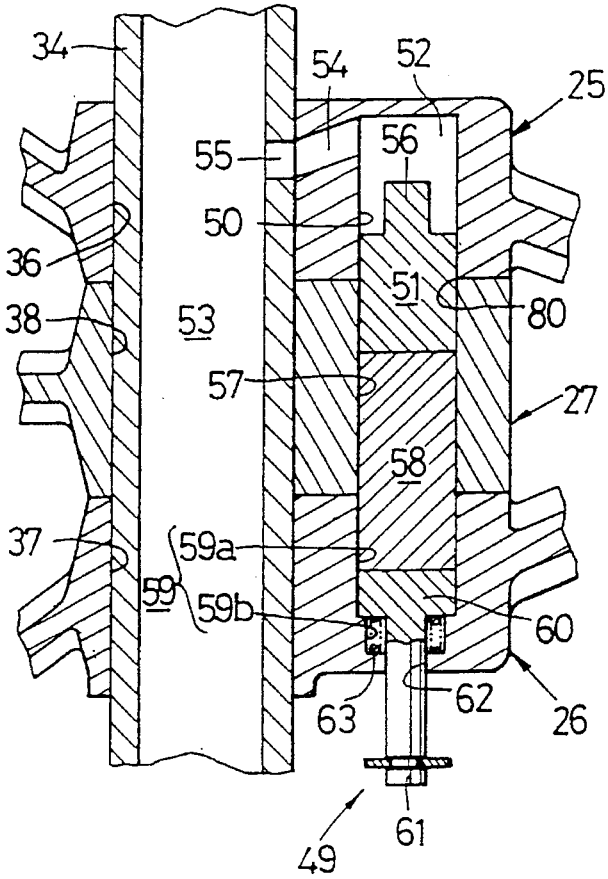
FIG. 5 is a sectional view similar to FIG. 3 but illustrating the condition, after switching, of the intake valve operation characteristic changing means.

When the engine is in a high speed operation, hydraulic pressure is supplied to both the hydraulic pressure chambers 52 and 67. When the hydraulic pressure is supplied to the intake-side hydraulic pressure chambers 52, the first connecting pin 51 urges the second connecting pin 58 and the stopper 60 against the resilient force of the return spring 63, as shown in FIG. 5, and during this time, a portion of the first connecting pin 51 is fitted into the guide hole 57, and a portion of the second connecting pin 58 is fitted into the second guide hole 59. In such condition, the first, second and third intake-side rocker arms 25, 26 and 27 are inhibited from random swinging movement, but are swung in unison with one another. Moreover, the swinging amount of the third intake-side rocker arm 27, in sliding contact with the first intake-side cam 30, is largest and hence, the first and second intake-side rocker arms 25 and 26 are also swung along with the third intake-side rocker arm 27 in accordance with the movement of the first intake-side cam 30.

When the hydraulic pressure is supplied to the exhaust-side hydraulic pressure chamber 67, the connecting pin 66 urges the stopper 73 against the resilient force of the return spring 76 and during this time, a portion of the connecting pin 66 is fitted into the guide hole 72. In such condition, the first and second exhaust-side rocker arms 28 and 29 are inhibited from relative swinging movement, but are swung in unison with each other in accordance with the movement of the exhaust-side cam 33.

Thus, both the intake valves 10 are opened and closed in accordance with the shape of the first intake-side cam 30, and both the exhaust valves are opened and closed in accordance with the shape of the exhaust-side cam 33. In this manner, the opening and closing mode, and thus the opening and closing timing and the lift amount for the intake valves 10 and the exhaust valves 11, can be varied in correspondence with the low-speed and high-speed operating ranges, respectively, thereby providing a reduction in specific fuel consumption and an increase in engine output.

Figure 6:
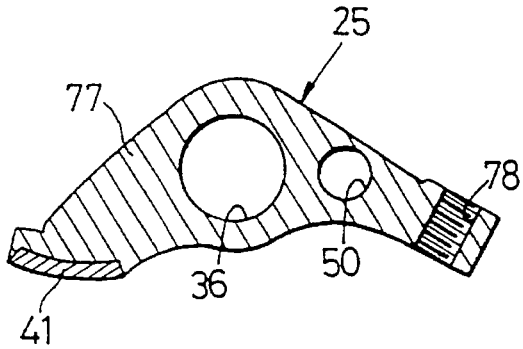
FIG. 6 is a sectional view of a rocker arm taken along a line 6—6 in FIG. 2 looking in the direction of the arrows.

FIG. 6 illustrates the first intake-side rocker arm 25. The first intake-side rocker arm 25 includes a rocker arm body 77 and the slipper surface forming piece 41 affixed to the rocker body 77. The rocker arm body 77 has the support hole (shaft insertion hole) 36 through which the rocker shaft 34 is rotatably inserted, the first guide hole (shaft insertion hole) 50 into which the first connecting pin 51 is slidably fitted, and a female threaded bore 78 into which the tappet screw 43 is threadedly engaged.

Figure 7A:
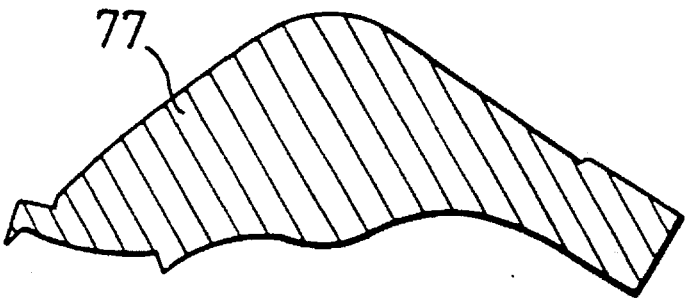
FIGS.7A and 7B are views for explaining the instant process for fabricating a rocker arm blank.
Figure 7B:
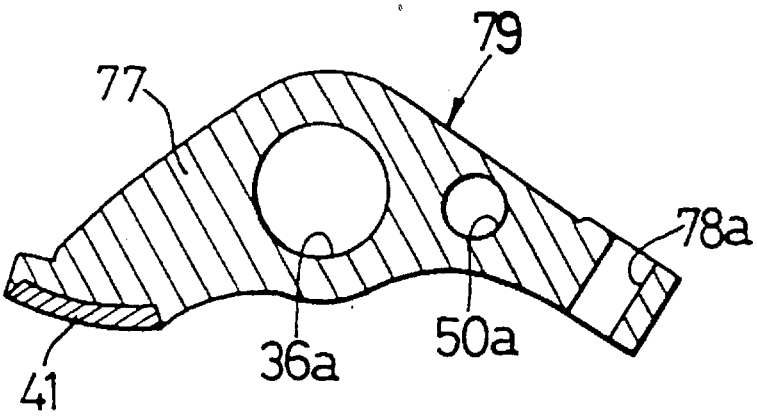

In making the first intake-side rocker arm 25, the following steps are used in sequence:

subjecting steel to a hot forging to produce a rocker body 77, as shown in FIG. 7A;

brazing a slipper surface forming piece 41 to the rocker arm body 77 and forming a first aperture **36*a* for a support hole, a second aperture 50*a* for a first guide hole and a third aperture 78*a* for a female threaded bore by drilling to produce a rocker arm blank 79** as shown in FIG. 7B;

refining the rocker arm blank 79;

subjecting the first aperture **36*a* for the support hole and the second aperture 50*a* for the first guide hole to a reaming to provide a support hole 36 and a first guide hole 50, respectively, and subjecting the third aperture 78*a* for female threaded bore 78 to a tapping to provide the female threaded bore 78; and subjecting the rocker arm blank 79 to a nitriding treatment. If strict dimensional accuracy is required for the support hole 36 and the first guide hole 50**, they may be subjected to burnishing prior to the nitriding treatment.

Table I shows the composition of the nitrided steel used in each of examples 1 to 3 and comparative examples 1 and 2.

TABLE 1

| | Chemical constituent (% by weight) | | | | | | | | | | | |
|---|---|---|---|---|---|---|---|---|---|---|---|---|
| Material | C | Mn | Cr | Al | Si | P | S | Cu | Ni | Pb | Bi | Mo |
| Example 1 | 0.31 | 0.99 | 0.98 | 1.08 | 0.24 | 0.014 | 0.019 | 0.04 | 0.03 | 0.07 | — | — |
| Example 2 | 0.33 | 0.98 | 0.98 | 1.08 | 0.28 | 0.016 | 0.016 | 0.03 | 0.04 | — | 0.05 | — |
| Example 3 | 0.48 | 0.38 | 1.46 | 0.98 | 0.24 | 0.015 | 0.002 | 0.09 | 0.08 | 0.08 | — | 0.16 |
| Comparative example 1 | 0.09 | 1.01 | 0.98 | 0.24 | 0.25 | 0.012 | 0.021 | 0.05 | 0.03 | 0.07 | — | — |
| Comparative example 2 | 0.32 | 1.01 | 1.01 | 0.19 | 0.33 | 0.01 | 0.01 | 0.05 | 0.04 | 0.09 | — | — |

In the refining treatment, hardening conditions included a treating temperature ($T_1$) of 910° C. and a treating time ($t_1$) of 1 hour, and oil-cooling was used. Tempering conditions included a treating temperature ($T_2$) of 690° C. and a treating time ($t_2$) of 2 hours. This refining treatment adjusted the hardness (HRC) of the rocker arm blank 79 and thus of the rocker arm body 77, to 25 (HRC=25).

The nitriding treatment used was a gas, soft nitriding treatment. A gas mixture consisting of 50% of halogen gas and 50% of cracked ammonia gas was used; the treating temperature ($T_3$) was set at 570°C., and the treating time ($t_3$) was set at 5 hours.

To examine the material strength characteristic for the first intake-side rocker arms 25 produced in examples 1 to 5 and comparative examples 1 and 2, the strength at yield point was measured. Further, the hardness and wear amount were measured for the opening edge 80 (see FIGS.3 and 5) of the first guide hole 50 which requires a strict wear-resistance against collision with the second connection pin 58 during shifting of the second connecting pin 58. In measuring the wear amount of the opening edge 80, the engine was rotated at 5,000 rpm and the lift load of the valve spring 20 was set at 32 kg. Under this condition, as one cycle, the second connection pin 58 was shifted from the low speed side to the high speed side where the pin 58 was retained for 0.5 seconds, then the pin 58 was shifted from the high speed side to the low speed side where the pin 58 was retained for 0.5 seconds. Such reciprocal shifting of the pin 58 was repeated continuously on this schedule for 400,000 cycles. Thereafter, the amount of wear on the opening edge 80 was measured.

Table 2 shows results of the measurements.

TABLE 2

| Rocker arm | Strength at yield point (kgf/mm$^2$) | Opening edge of first guide hole: Hardness HMV | Opening edge of first guide hole: Wear amount (mm) |
|---|---|---|---|
| Example 1 | 71.0 | 910 | 0.12 |
| Example 2 | 71.0 | 950 | 0.13 |
| Example 3 | 73.0 | 980 | 0.13 |
| Comparative example 1 | 37.6 | 820 | 0.20 |
| Comparative example 1 | 77.2 | 750 | 0.17 |

As will be apparent from the data reported in Table 2, as compared with the properties of the rocker arms of comparative examples 1 and 2, the first intake-side rocker arm 25 in each of examples 1 to 3 had an excellent strength at yield point and showed a smaller wear amount at the opening edge 80 of the first guide hole 50 and hence, had excellent mechanical characteristics. Further, as compared with the rocker arm of comparative examples 1 and 2, the first intake-side rocker arm 25 in example 3 had an increased hardness because of the Mo contained therein. The amounts of wear of the inner surfaces of the first guide hole 50 and the support hole 36 were extremely small, because the sliding conditions were quite moderated, as compared with the opening edge 80.

It will be appreciated that the other intake-side and exhaust-side rocker arms 26, 27, 28 and 29 may be made in the same manner as described above. It will be also understood that the present invention is applicable to the production of a rocker arm having no guide hole. Further, the slipper surface forming piece may be replaced by a roller.

What is claimed is:

1. A process for producing a rocker arm for an internal combustion engine comprising the steps of:

fabricating a rocker arm blank which has an aperture adapted to be converted into a shaft insertion hole which is made of steel comprising:

0.3% (inclusive) to 0.5% (inclusive) by weight of carbon (C), 0.3% (inclusive) to 1.5% (inclusive) by weight of manganese (Mn), 0.9% (inclusive) to 1.5% (inclusive) by weight of chromium (Cr), 0.7% (inclusive) to 1.5% (inclusive) by weight of aluminum (Al), 0.35% by weight or less of silicon (Si), 0.03% by weight or less of phosphorus (P), 0.03% by weight or less of sulfur (S), 0.3% by weight or less of copper (Cu), 0.25% by weight or less of nickel (Ni), at least one member of the group consisting of 0.04% (inclusive) to 0.15% (inclusive) by weight of lead (Pb), and 0.03% (inclusive) to 0.1% (inclusive) by weight of bismuth (Bi), and the balance substantially of iron, with the normal impurities;

refining said rocker arm blank by:

hardening at a treating temperature ($T_1$) of 850° (inclusive) to 950° C. (inclusive) for a treating time ($t_1$) of 0.5 (inclusive) to 2 (inclusive) hours;

reaming said aperture an amount sufficient to form said shaft insertion hole; and nitriding said reamed rocker arm blank at a treating temperature ($T_3$) of 550°(inclusive) to 610° C.(inclusive) for a treating time ($t_3$) of 5 (inclusive) to 8 (inclusive) hours.

2. A process for producing a rocker arm for an internal combustion engine as claimed in claim 1 additionally comprising: 0.15% (inclusive) to 0.3% (inclusive) by weight of molybdenum (Mo) in said steel.

* * * * *